US010097933B2

(12) United States Patent
Shennib

(10) Patent No.: US 10,097,933 B2
(45) Date of Patent: Oct. 9, 2018

(54) SUBSCRIPTION-CONTROLLED CHARGING OF A HEARING DEVICE

(71) Applicant: iHear Medical, Inc., San Leandro, CA (US)

(72) Inventor: Adnan Shennib, Oakland, CA (US)

(73) Assignee: iHear Medical, Inc., San Leandro, CA (US)

( * ) Notice: Subject to any disclaimer, the term of this patent is extended or adjusted under 35 U.S.C. 154(b) by 0 days.

(21) Appl. No.: 14/876,545

(22) Filed: Oct. 6, 2015

(65) Prior Publication Data

US 2016/0100261 A1 Apr. 7, 2016

Related U.S. Application Data

(60) Provisional application No. 62/060,349, filed on Oct. 6, 2014.

(51) Int. Cl.
*H04R 25/00* (2006.01)

(52) U.S. Cl.
CPC ..... *H04R 25/602* (2013.01); *H04R 25/554* (2013.01); *H04R 25/556* (2013.01); *H04R 2225/31* (2013.01)

(58) Field of Classification Search
CPC ..... H04R 25/602; H04R 25/556; H04R 2225/31; H04R 2225/41; H04R 2225/38
USPC ..... 381/323, 312; 320/108
See application file for complete search history.

(56) References Cited

U.S. PATENT DOCUMENTS 4,759,070 A 7/1988 Voroba et al.
5,197,332 A 3/1993 Shennib
5,327,500 A 7/1994 Campbell
5,553,152 A 9/1996 Newton
5,645,074 A 7/1997 Shennib et al.
5,659,621 A 8/1997 Newton
5,701,348 A 12/1997 Shennib et al.
5,785,661 A 7/1998 Shennib et al.
6,137,889 A 10/2000 Shennib et al.
6,212,283 B1 4/2001 Fletcher et al.
6,319,207 B1 11/2001 Naidoo
(Continued)

FOREIGN PATENT DOCUMENTS

KR 100955033 B1 4/2010
KR 1020100042370 A 4/2010
(Continued)

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.
(Continued)

*Primary Examiner* — Sunita Joshi
(74) *Attorney, Agent, or Firm* — Dorsey & Whitney LLP

(57) ABSTRACT

Examples of a subscription-based rechargeable hearing device system and methods are described. An exemplary system includes a hearing device and a charging device to charge the hearing device according to a subscription status. In some examples, a charging station automatically disengages the rechargeable battery cell upon insertion of the hearing device partially into a receptacle cavity of the charging station. The subscription may be verified using a remote server in communication with a subscription database.

36 Claims, 10 Drawing Sheets

(56) References Cited

U.S. PATENT DOCUMENTS 6,359,993 B2 3/2002 Brimhall
6,367,578 B1 4/2002 Shoemaker
6,379,314 B1 4/2002 Horn
6,382,346 B2 5/2002 Brimhall et al.
6,428,485 B1 8/2002 Rho
6,447,461 B1 9/2002 Eldon
6,473,513 B1 10/2002 Shennib et al.
6,522,988 B1 2/2003 Hou
6,546,108 B1 4/2003 Shennib et al.
6,674,862 B1 1/2004 Magilen
6,724,902 B1 4/2004 Shennib et al.
6,816,601 B2 11/2004 Lin et al.
6,840,908 B2 1/2005 Edwards et al.
6,937,735 B2 8/2005 DeRoo et al.
6,940,988 B1 9/2005 Shennib et al.
6,978,155 B2 12/2005 Berg
7,010,137 B1 3/2006 Leedom et al.
7,016,511 B1 3/2006 Shennib
7,037,274 B2 5/2006 Thoraton et al.
7,113,611 B2 9/2006 Leedom et al.
7,215,789 B2 5/2007 Shennib et al.
7,221,769 B1 5/2007 Jorgensen
7,260,232 B2 8/2007 Shennib
7,298,857 B2 11/2007 Shennib et al.
7,310,426 B2 12/2007 Shennib et al.
7,321,663 B2 1/2008 Olsen
7,330,101 B2 2/2008 Sekura
7,403,629 B1 7/2008 Aceti et al.
7,424,123 B2 9/2008 Shennib et al.
7,424,124 B2 9/2008 Shennib et al.
7,580,537 B2 8/2009 Urso et al.
7,664,282 B2 2/2010 Urso et al.
7,854,704 B2 12/2010 Givens et al.
7,945,065 B2 5/2011 Menzl et al.
8,073,170 B2 12/2011 Kondo et al.
8,077,890 B2 12/2011 Schumaier
8,155,361 B2 4/2012 Schindler
8,184,842 B2 5/2012 Howard et al.
8,243,972 B2 8/2012 Latzel
8,284,968 B2 10/2012 Schumaier
8,287,462 B2 10/2012 Givens et al.
8,340,335 B1 12/2012 Shennib
8,379,871 B2 2/2013 Michael et al.
8,396,237 B2 3/2013 Schumaier
8,447,042 B2 5/2013 Gurin
8,467,556 B2 6/2013 Shennib et al.
8,571,247 B1 10/2013 Oezer
8,718,306 B2 5/2014 Gommel et al.
8,767,986 B1 * 7/2014 Fabry ..... H04R 25/70 381/314
8,798,301 B2 8/2014 Shennib
8,855,345 B2 10/2014 Shennib et al.
9,060,233 B2 6/2015 Shennib et al.
9,559,544 B2 * 1/2017 Jakubowski ..... H02J 5/005
9,769,577 B2 9/2017 Shennib
9,805,590 B2 10/2017 Shennib
2001/0008560 A1 7/2001 Stonikas et al.
2002/0027996 A1 3/2002 Leedom et al.
2002/0085728 A1 7/2002 Shennib et al.
2003/0007647 A1 1/2003 Nielsen et al.
2003/0137277 A1 * 7/2003 Mori ..... G01R 31/3648 320/132
2004/0138723 A1 7/2004 Malick et al.
2004/0165742 A1 8/2004 Shennib et al.
2005/0190938 A1 9/2005 Shennib et al.
2005/0245991 A1 11/2005 Faltys et al.
2005/0249370 A1 11/2005 Shennib et al.
2005/0259840 A1 11/2005 Gable et al.
2005/0283263 A1 * 12/2005 Eaton ..... H04R 25/554 700/94
2006/0210104 A1 9/2006 Shennib et al.
2006/0291683 A1 12/2006 Urso et al.
2007/0019834 A1 1/2007 Nielson
2007/0076909 A1 4/2007 Roeck et al.
2007/0127757 A2 6/2007 Darbut et al.
2007/0195966 A1 * 8/2007 Fink ..... A61B 5/0002 381/60
2007/0255435 A1 11/2007 Cohen et al.
2008/0240452 A1 10/2008 Burrows et al.
2008/0273726 A1 11/2008 Yoo et al.
2010/0027824 A1 2/2010 Atamaniuk et al.
2010/0040250 A1 2/2010 Gebert
2010/0119094 A1 5/2010 Sjursen et al.
2010/0145411 A1 6/2010 Spitzer
2010/0201513 A1 * 8/2010 Vorenkamp ..... H02J 7/025 340/539.13
2010/0232612 A1 9/2010 Basseas et al.
2010/0239112 A1 9/2010 Howard et al.
2010/0254554 A1 10/2010 Fusakawa et al.
2010/0284556 A1 11/2010 Young
2011/0058697 A1 3/2011 Shennib et al.
2011/0188689 A1 8/2011 Beck et al.
2011/0200216 A1 8/2011 Lee et al.
2011/0206225 A1 8/2011 Møller et al.
2011/0221391 A1 * 9/2011 Won ..... H01M 10/44 320/108
2011/0293123 A1 * 12/2011 Neumeyer ..... H04R 25/50 381/314
2012/0051569 A1 3/2012 Blamey et al.
2012/0130271 A1 5/2012 Margolis et al.
2012/0183164 A1 7/2012 Foo et al.
2012/0183165 A1 7/2012 Foo et al.
2012/0189140 A1 7/2012 Hughes
2012/0189146 A1 * 7/2012 Wuidart ..... H04M 1/6066 381/312
2012/0213393 A1 8/2012 Foo et al.
2012/0215532 A1 8/2012 Foo et al.
2012/0302859 A1 11/2012 Keefe
2013/0010406 A1 1/2013 Stanley
2013/0243209 A1 9/2013 Zurbruegg et al.
2013/0243229 A1 * 9/2013 Shennib ..... H04R 25/602 381/323
2013/0294631 A1 11/2013 Shennib et al.
2014/0003639 A1 1/2014 Shennib et al.
2014/0029777 A1 1/2014 Jang
2014/0150234 A1 6/2014 Shennib et al.
2014/0153761 A1 6/2014 Shennib et al.
2014/0153762 A1 6/2014 Shennib et al.
2014/0254843 A1 9/2014 Shennib
2014/0254844 A1 9/2014 Shennib
2015/0003651 A1 1/2015 Han et al.
2015/0023512 A1 1/2015 Shennib
2015/0023534 A1 1/2015 Shennib
2015/0139474 A1 5/2015 Henry et al.
2016/0049074 A1 2/2016 Shennib
2016/0057550 A1 2/2016 Shennib
2017/0180883 A1 6/2017 Sommer et al.
2017/0332183 A1 11/2017 Shennib
2018/0025627 A1 1/2018 Shennib

FOREIGN PATENT DOCUMENTS

WO 99/07182 A2 2/1999
WO 2010/091480 A1 8/2010
WO 2011128462 A2 10/2011
WO 2011159349 A1 12/2011
WO 2015009564 A1 1/2015
WO 2015009569 A1 1/2015
WO 2016025826 A1 2/2016

OTHER PUBLICATIONS

"Methods for Calculation of the Speech Intelligibility Index", American National Standards Institute, Jun. 6, 1997.
"Specification for Audiometers", American National Standards Institute, Nov. 2, 2010.
"User Manual—2011", AMP Personal Audio Amplifiers.
Abrams, "A Patient-adjusted Fine-tuning Approach for Optimizing the Hearing Aid Response", The Hearing Review, Mar. 24, 2011, 1-8.

(56) References Cited

OTHER PUBLICATIONS

Asha, "Type, Degree, and Configuration of Hearing Loss", American Speech-Language-Hearing Association; Audiology Information Series, May 2011, 1-2.
Convery, et al., "A Self-Fitting Hearing Aid: Need and Concept", http://tia.sagepubl.com, Dec. 4, 2011, 1-10.
Franks, "Hearing Measurements", National Institute for Occupational Safety and Health, Jun. 2006, 183-232.
Kiessling, "Hearing aid fitting procedures—state-of-the-art and current issues", Scandinavian Audiology vol. 30, Suppl 52, 2001, 57-59.
Nhanes, "Audiometry Procedures Manual", National Health and Nutrition Examination Survey, Jan. 2003, 1-105.
Traynor, "Prescriptive Procedures", www.rehab.research.va.gov/mono/ear/traynor.htm, Jan. 1999, 1-16.
World Health Organization, , "Deafness and Hearing Loss", www.who.int/mediacentre/factsheets/fs300/en/index.html, Feb. 2013, 1-5.
Wu, et al., "Selective Signal Transmission to Inlaid Microcoils by Inductive Coupling", IEEE Transducers 2003, 12th International Conference of Solid State Sensors Transducers, Boston 2003.
U.S. Appl. No. 15/724,854, entitled "Hearing Device and Methods for Wireless Remote Control of an Appliance" filed Oct. 4, 2017.

* cited by examiner

SUBSCRIPTION-CONTROLLED CHARGING OF A HEARING DEVICE

CROSS-REFERENCE TO RELATED APPLICATIONS

This application claims the benefit under 35 U.S.C. 119 of the earlier filing date of U.S. Provisional Application No. 62/060,349 entitled "SUBSCRIPTION-CONTROLLED CHARGING OF A HEARING DEVICE," filed Oct. 6, 2014. The aforementioned provisional application is hereby incorporated by reference in its entirety, for any purpose.

TECHNICAL FIELD

Examples described herein relate to hearing devices, and include particularly subscription-based rechargeable hearing devices.

BACKGROUND

The ear canal is generally narrow and tortuous and is approximately 26 millimeters (mm) long from the canal aperture 11 to the tympanic membrane 15 (eardrum). The lateral part 12 is referred to as the cartilaginous region due to the underlying cartilaginous tissue 16 beneath the skin. The medial part, proximal to the tympanic membrane 15, is rigid and referred to as the bony region 13 due to the underlying bone tissue 17. A characteristic first bend occurs roughly at the aperture 11 of the ear canal. A second characteristic bend occurs roughly at the bony-cartilaginous junction 8 and separates the cartilaginous region 12 and the bony region 13. The ear canal 14 is generally hidden from view (front and side) behind a backward projecting eminence known as the tragus. The ear canal is also hidden from view from the back by the presence of the pinna (also referred to as auricle). The dimensions and contours of the ear canal 14 vary significantly among individuals.

Placement of a hearing device inside the ear canal 14 is generally desirable for various electroacoustic advantages such as reduction of the acoustic occlusion effect, improved energy efficiency, reduced distortion, reduced speaker vibrations, and improved high frequency response. Canal placement may also be desirable for cosmetic reasons since the majority of the hearing impaired may prefer to wear an inconspicuous hearing device. A canal hearing device can be inserted entirely or partially inside the ear canal. In the context of this application, any hearing device inserted inside the ear canal, whether partially or completely, may be referred to as a canal hearing device. This includes what is known in the hearing aid industry as Completely In the Canal (CIC), Receiver-In-Canal, (RIC), In-The-Canal (ITC), and extended wear deep canal invisible types.

Hearing devices may include a battery, which may be disposable or rechargeable. With either disposable or rechargeable batteries, removal (e.g., for charging) or replacement of the battery may be difficult or cumbersome for some users, particularly those with impaired dexterity, due to a relatively small form factor of hearing devices. In addition, the entry cost for a hearing device may be substantially high making it cost prohibitive for a large number of potential users to purchase a hearing device. Improvements in the field of hearing devices and systems may be desirable.

SUMMARY

A rechargeable hearing device system may include a hearing device, a charging device, and a remote server. The hearing device may include a main section and a lateral section. The main section may be positioned in the ear and may include a speaker. The lateral section may be coupled to the main section. The lateral section may incorporate a rechargeable battery cell therein. The hearing device may include memory storing identification data. A status, such as a subscription status, of the hearing device may be determined based, at least in part, on the identification data. The hearing device may receive electrical charge from the charging device based, at least in part, on the identification data. The hearing device may receive a programming signal through a programming interface. The hearing device may include wireless circuitry.

The charging device may include a charging port configured to be electrically coupled to the hearing device. The charging device may include charging circuitry to selectively provide electrical energy to the hearing device when the hearing device is coupled thereto. The charging device may be configured to provide electrical energy to the rechargeable battery cell of the hearing device upon a validation of a subscription of the hearing device. In some examples, the charging device is a computing device. In some examples, the charging device is a charging station. A software program may be configured to control the charging circuitry responsive to a determination of a valid subscription.

The charging station may include a receptacle cavity configured to receive a lateral end of the hearing device. The receptacle cavity may be configured to automatically electrically disengage the rechargeable battery cell provided within the hearing device. The rechargeable battery cell may be disengaged from the hearing device and electrically engaged to the charging station responsive to an insertion force.

The remote server may be accessible to the charging device. The remote server may be accessible through a network. The remote server may be coupled to a remote subscription database. The remote server may be configured to access and/or retrieve subscription data on the remote subscription database. The subscription data may be associated with the subscription status of the hearing device. Charging of the hearing device or a wireless service may be enabled or disabled in accordance with the subscription status.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Figure 1:
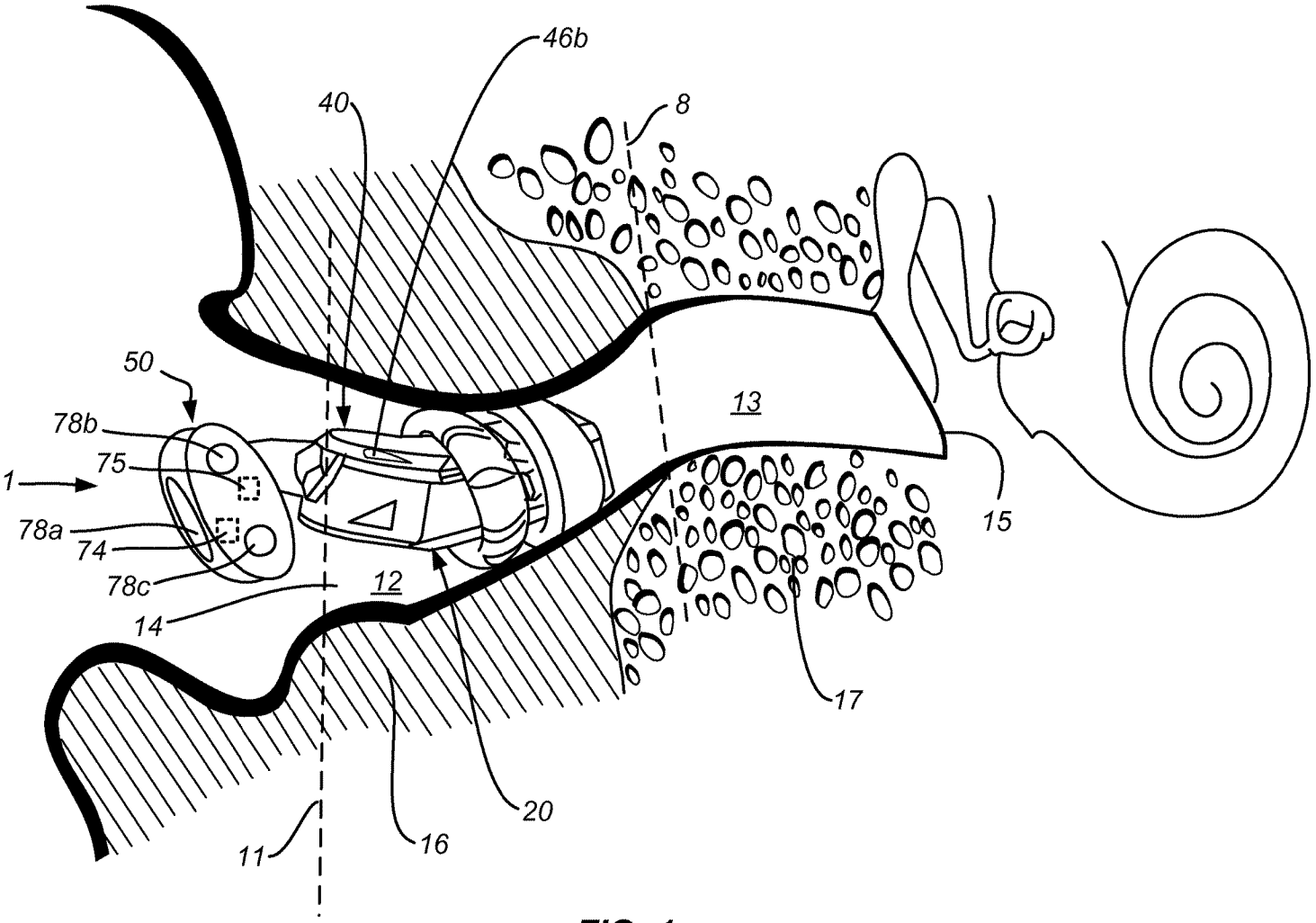
FIG. 1 is a view of the ear canal, showing an example of a rechargeable canal hearing device assembly inserted therein.

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

The present disclosure describes examples of rechargeable hearing devices and systems which may include selectively enabled features and/or charging functionality. Certain canal hearing devices, for example hearing aids, may include conventional batteries such as zinc-air varieties, which are generally non-rechargeable, and may thus be replaced frequently by the user. Given the advanced age of the average hearing aid user and diminutive size of hearing aid batteries, it may be an inconvenient and often a frustrating task to replace the batteries due to decreased dexterity and/or impaired vision and/or generally smaller form factor of the canal hearing device. Furthermore, standard zinc-air batteries can drain prematurely due to internal discharge after removing the air-access tab, as known in the hearing aid field. Rechargeable hearing aids may be advantageous in this regard however conventional hearing aids with rechargeable batteries may be generally limited to the relatively unsightly larger devices in the form of Behind-The-Ear (BTE), In-The-Ear, and Receiver-In-The-Canal (RIC). In addition, the cost of a canal hearing device can be several thousands of dollars which may be prohibitive to many potential consumers. According to industry reports, roughly 1 in 5 hearing impaired people own a hearing device, leaving the majority without a hearing solution. The high cost of canal hearing devices may be due, in part, to the inclusion of extra features in canal hearing devices which may or may not be needed or usable by a particular individual.

Examples according to the present disclosure may provide canal hearing devices and systems, which include a rechargeable battery in a smaller form factor than some conventional and relatively larger BTE and RIC devices. Rechargeable hearing devices and systems may include functionality for selectively enabling features and/or charging the battery of the hearing device. According to some examples, canal hearing devices and systems may be configured to selectively enable charging and/or certain features of the canal hearing device in response to verification of a subscription associated with the hearing device. According to some examples, selective charging and/or enabling of features may be responsive to a validated subscription associated with the hearing device. Subscription-based models can be advantageous to defray the upfront cost ownership or use. Furthermore, a subscription-based business model may allow a consumer to subscribe to certain selected features and services, thereby eliminating costs associated with unwanted features.

The present disclosure describes examples of rechargeable hearing devices and systems which may provide functionality for selectively enabling charging and/or features of the canal hearing device. Rechargeable hearing devices and systems may include functionality for selectively enabling features and/or charging the battery of the hearing device. According to some examples, hearing devices and systems may be configured to selectively enable charging and/or certain features of the hearing device in response to verification of a status of the hearing device. According to some examples, selective charging and/or enabling of features may be responsive to a validated subscription associated with the hearing device.

A rechargeable hearing device system according to examples of the present disclosure may include, on a client side 2, a canal hearing device 1 (interchangeably referred to herein as a canal hearing device assembly or a hearing device) and a charging device 70. The charging device 70 may include a charging port. The charging device 70 may be a charging station 60 or a computing device 10. In some examples, the charging device may be configured for wirelessly charging the hearing device 1, e.g., via inductive coils provided in the charging device and the hearing device. The charging device may include functionality to selectively enable charging of the hearing device 1.

The charging station 60 adapted to supply electrical energy to the hearing device 1 upon a verification of a status of the hearing device 1. In some examples, the verification of the status may include a validation of a subscription associated with the hearing device 1. In some examples, the canal hearing device 1 is charged by coupling electrical contacts of the hearing device 1 with electrical contacts **76*a* and 76*b* of a charging station 60. In some examples, the hearing device 1 may be charged wirelessly by the charging station 60. In some examples, the charging station may be configured to selectively enable transmission of electrical energy, e.g., via the electrical contacts or wirelessly via a transmission coil, to the hearing device 1 upon verification of the status of the hearing device 1**. Although examples herein relate to canal hearing devices, it will be understood that systems and methods disclosed herein may also be applicable to BTE, RIC, portable sound amplification products (PSAP), or any other type of hearing device.

In some examples, the rechargeable hearing device system may include a hearing device 1 having a main section 20, a lateral section 40, and a charging station 60. The main section 20 may include durable components, such as a microphone, a speaker 57, a wireless electronics 74, a wireless antenna 75, and sound processing circuitry. The hearing device 1 may be configured for positioning on or in the ear. The hearing device may include a memory, for example non-volatile memory. The memory may be provided in the main section or the lateral section. The memory may store identification data 82, as described herein. The lateral section 40 may incorporate a rechargeable battery cell 42 therein. In some examples, the hearing device 1 may be an integrated assembly. In some examples the hearing device 1 may include a modular main section 20 (also referred to as main module) and a modular lateral section 40 (also referred to as lateral module). The lateral module 40 may be configured for mating with the main module 20 to form a canal hearing device 1. The speaker 57 of the hearing device 1 may be configured to transmit sounds 55 into the ear canal 14 of a user 100.

The charging station 60 may be configured to provide electrical charge (also referred to herein as "electrical energy") to the battery cell 42 within the canal hearing device assembly 1. In some examples, the charging station 60 may include a receptacle cavity for receiving part of the canal hearing device 1. The charging station 60 may include a charging port. In some examples, the charging port may be incorporated within the receptacle cavity 71 of the charging station 60 for charging of the canal hearing device 1.

The charging station 60 may include one or more electrical contacts, for example 76*a* and/or 76*b*, for establishing a direct electrical connection with one or more electrical contacts, for example 46*a* and/or 46*b*, on the exterior of the hearing device 1. In some examples, the charging station 60 may be configured to provide electrical energy wirelessly to the battery cell 42, for example by inductive coupling. That is, the charging station 60 may include an inductive coil 64 (FIG. 4) configured to be inductively couple energy to the battery cell 42 within the hearing device 1 via an inductive coil 49 provided in the hearing device 1. The charging station 60 may include a wired or wireless connector, such as a USB connector 61 or any other standard connector, for coupling the charging station 60 to an external device or a power source. In some examples, the charging station 60 may include a rechargeable battery for powering the charging station 60 and for use as a power source for charging the hearing device 1. The hearing device 1 and charging system 60 may be configured according to any of the examples in U.S. Pat. No. 8,467,556, titled, "CANAL HEARING DEVICE WITH DISPOSABLE BATTERY MODULE," U.S. Pat. No. 8,855,345, titled, "BATTERY MODULE FOR PERPENDICULAR DOCKING INTO A CANAL HEARING DEVICE," and U.S. Pat. No. 9,060,233, titled, "RECHARGEABLE CANAL HEARING DEVICE AND SYSTEMS," and U.S. patent application Ser. No. 14/832,751, titled, "CANAL HEARING DEVICE AND METHODS FOR WIRELESS REMOTE CONTROL OF AN APPLIANCE USING BEHIND THE TRAGUS SWITCH," filed Aug. 21, 2015, and U.S. patent application Ser. No. 14/826,721, titled, "CANAL HEARING DEVICE AND METHODS FOR WIRELESS REMOTE CONTROL OF AN APPLIANCE," filed Aug. 14, 2015, which patents and patent applications are incorporated by reference herein in their entirety for any purpose. In some examples, the hearing device 1 and/or charging station 60 may include functionality for selectively enabling charging and/or enabling features of the hearing device 1 as described herein.

In some examples, the client side 2 of the rechargeable hearing device system may include, in addition to or in place of the charging station 60, a computing device 10. The computing device 10 may be a client computer, a smartphone 31, a tablet, a portable media device, or any other device capable of executing computer instructions at a client side 2. The computing device 10 includes a processor and memory for storing executable instructions. The computing device 10 may be configured to execute the instructions to perform functions as described herein. The instructions may include instructions for executing one or more software applications, e.g., client validation app 32. The computing device 10 may include communications circuitry, such as a USB interface 38 or a wireless interface (e.g., Bluetooth). In some examples, the computing device 10 may be connected to a network 85, for example the Internet, to access a remote server 80 and web services. In some examples, the computing device 10 may include a charging port for directly coupling the hearing device 1 to the computing device 10 for selectively charging and/or enabling functionality of the hearing device 1. The charging port may be implemented using a variety of communication ports, such as a USB port. Electrical contacts of the charging port for charging may be implemented using electrical contacts of the USB interface 38. The hearing device 1 may couple to the computing device 10 using the USB interface 38 for charging of the hearing device 1 in accordance with a subscription.

In some examples, the charging station 60 may include a receptacle cavity 71 to receive a lateral end of the canal hearing device 1. The receptacle cavity 71 may include features configured to constrain a movement of the hearing device 1 with respect to the charging station 60 when inserted therein. The receptacle cavity 71 may include additional features, for example a structure configured to disengage the lateral section 40 relative to the main section 20 upon insertion of the lateral section 40 into the charging station 60. In some examples, the lateral section 40 may be partially disengaged from the main section 20 to provide the canal hearing device assembly 1 in an OFF condition before and during charging. The receptacle cavity 71 may incorporate a charging port therein. The charging port may include electrical contacts 76*a* and 76*b* for transmitting electrical charge to the canal hearing device 1. The charging port may control voltage levels and temperature levels so as to optimize transmittance of electrical charge to the canal hearing device 1.

Figure 2A:
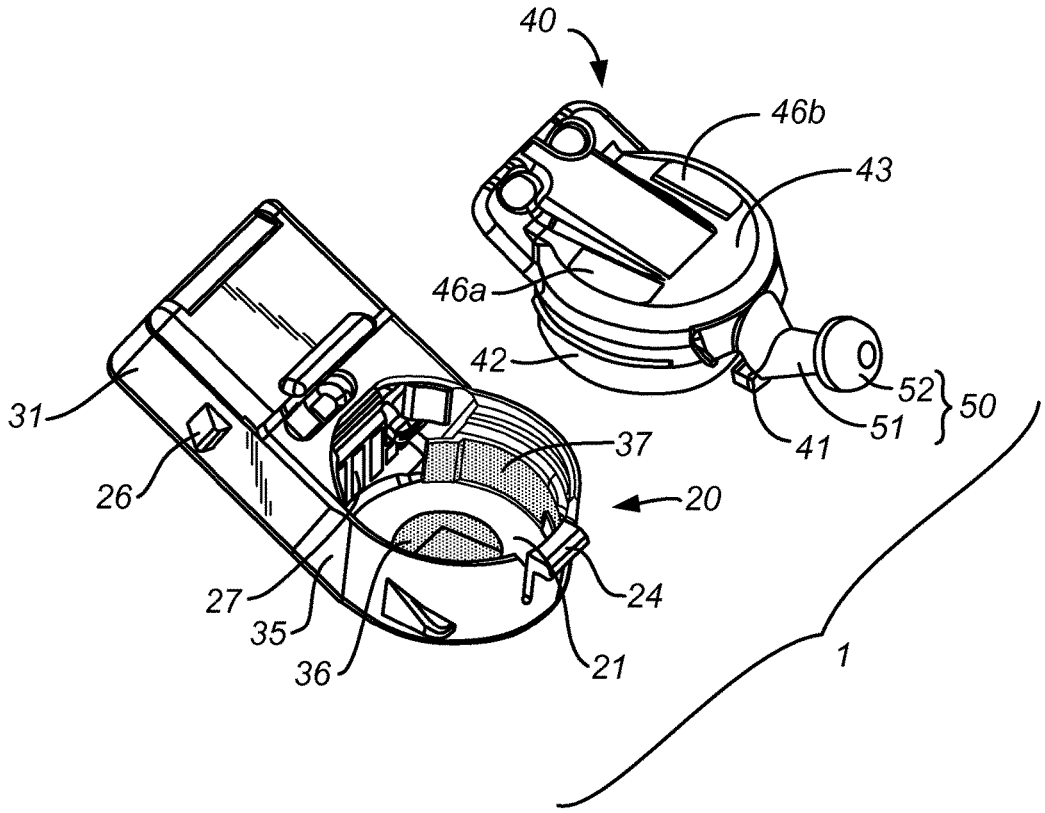
FIG. 2A is an isometric view of a modular rechargeable canal hearing device assembly depicting the battery module detached.
Figure 2B:
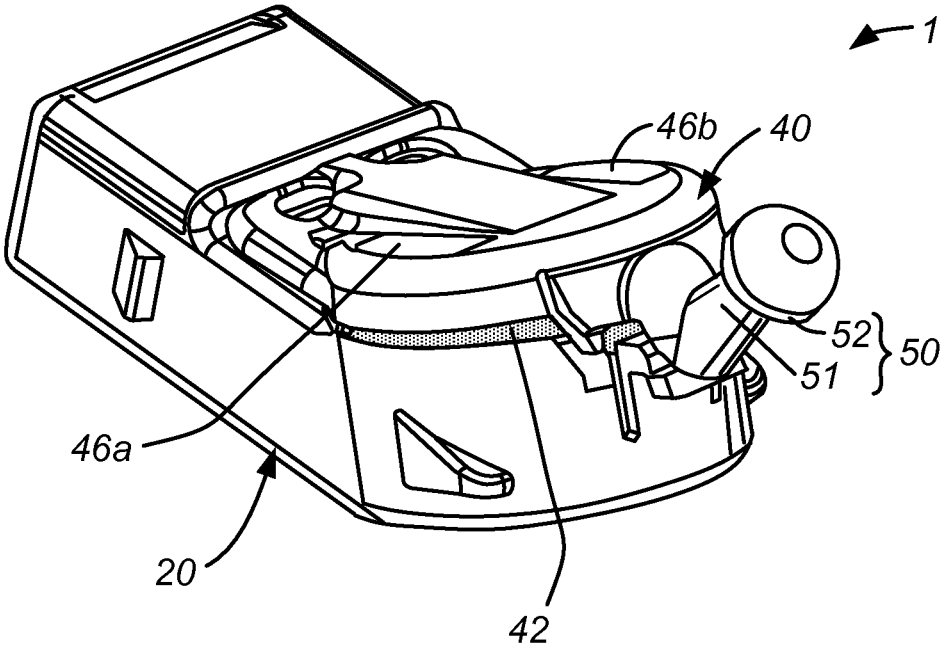
FIG. 2B is an isometric view of the modular canal hearing device of FIG. 2A, depicting the battery module partially disengaged from the main module representing the OFF condition.

As noted above, the hearing device 1 may be modular comprising a main module 20 and a lateral module 40, for example as shown in FIGS. 2A-2B. The main module 20 may include a receiving cavity 21, for example as shown in FIGS. 2A-2B, shaped to accommodate the rechargeable battery cell 42, at least partially within. The battery cell 42 may have a generally circular shape, and may for example be a button cell. The main module 20 may include electrical contacts 36 and 37 for electrically coupling the main module 20 with the battery cell 42 to power the electrical components within the main module 20 (e.g., amplifier circuitry and microphone).

The lateral section 40 may include a lateral section housing 43 that is generally sized and shaped according to the battery cell 42 incorporated therein, which may, in some examples, be substantially cylindrical. In some examples, the battery cell 42 may be integrated whereby the battery cell 42 is generally non-removable from the hearing device 1. By generally non-removable it is generally implied, in the context of the present disclosure, that the integrated battery cell 42 may not be replaced frequently as in the case of primary cells. In some examples, the non-removable battery cell 42 may be partially disengaged, as shown in FIG. 2B, so as to place the hearing device 1 in the OFF condition during charging. In some examples, the battery cell 42 may be removable from the hearing device 1.

The main section 20 may be coupled at its medial end 31 to an ear tip assembly 19. The ear tip assembly 19 is preferably manufactured of a flexible material, such as a polymer, and configured as a replaceable or disposable component. The ear tip assembly 19 may couple to the main section 20 by engaging with an ear tip holding tab 26 positioned generally on the medial end 31 of the main section 20.

In some examples, the lateral end of the hearing device 1 may include a handle portion 50. The handle portion may be provided on a lateral end of the main section 20 or the lateral section 40. The handle portion 50 may facilitate handling of the hearing device 1 during insertion or removal from the ear. The handle portion 50 may include a shaft 51 and a knob 52. In some examples, the handle portion 50 may include wireless electronics 74 and/or a wireless antenna 75 (collectively referred to as "wireless circuitry"). In some examples, the lateral end of the hearing device 1 may include switches 78*a-c* for manual activation.

In some examples, the lateral section 40 may include charging electrical contacts 46*a* and 46*b* for receiving electrical energy. The charging electrical contacts 46*a* and 46*b* may be positioned on the exterior surface of the lateral section 40, as shown in FIGS. 2A-2B. The charging electrical contacts 46*a* and 46*b* may be formed from an electrically conductive material, such gold-plated beryllium copper. The charging electrical contacts 46*a* and 46*b* may be positioned on the lateral section 40 so as to facilitate electrical engagement with charging station electrical contacts (for example 76*a* and 76*b*) located within the receptacle cavity 71 of the charging station 60. The charging electrical contact 46*a* may electrically couple with charging station electrical contact 76*a*. The charging electrical contact 46*b* may electrically couple with a charging electrical contact 76*b*.

In some examples, the lateral end of the hearing device 1 may include a communications port (not shown). The communications port may be implemented using a USB interface or any other standard so as to facilitate electrical charging and/or data communications between the charging station 60 and the hearing device 1. The hearing device 1 may include charging circuitry 77 for receiving electrical charge from a computing device 10 (e.g., FIG. 9) and/or the charging station 60 (e.g., FIGS. 4-8). The charging circuitry 77 of the hearing device 1 may be selectively enabled or disabled based, at least in part, on a verification of a status of the hearing device 1. In some examples, the charging circuitry 77 may be configured to be enabled or disabled in accordance with a subscription. The charging circuitry 77 of the hearing device 1 may control voltage levels and temperature so as to optimize charging of the hearing device 1.

Figure 3:
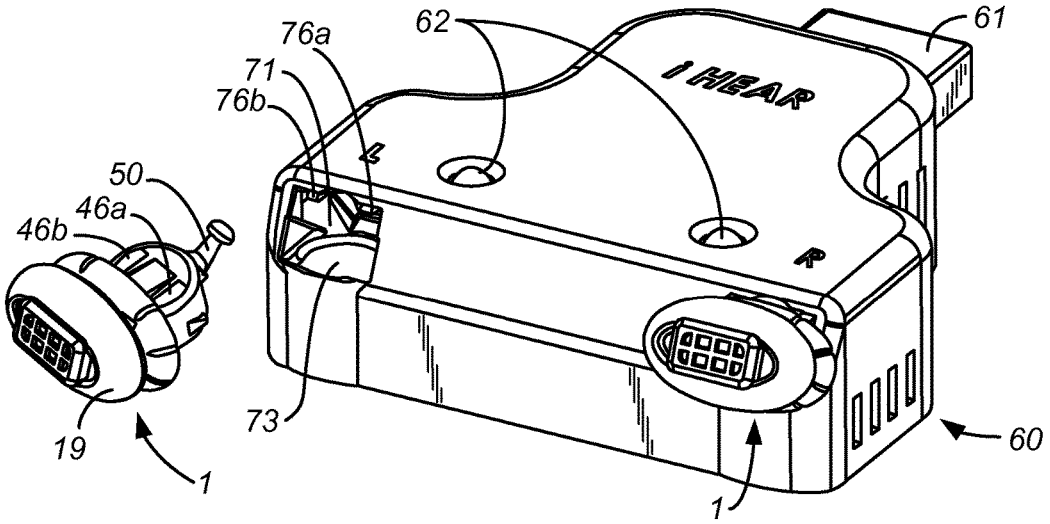
FIG. 3 is an isometric view of an example of a rechargeable hearing device system showing a first modular canal hearing device assembly prior to insertion into a first (left) receptacle cavity of a charging station, and a second modular canal hearing device assembly inserted into a second (right) receptacle cavity.
Figure 4:
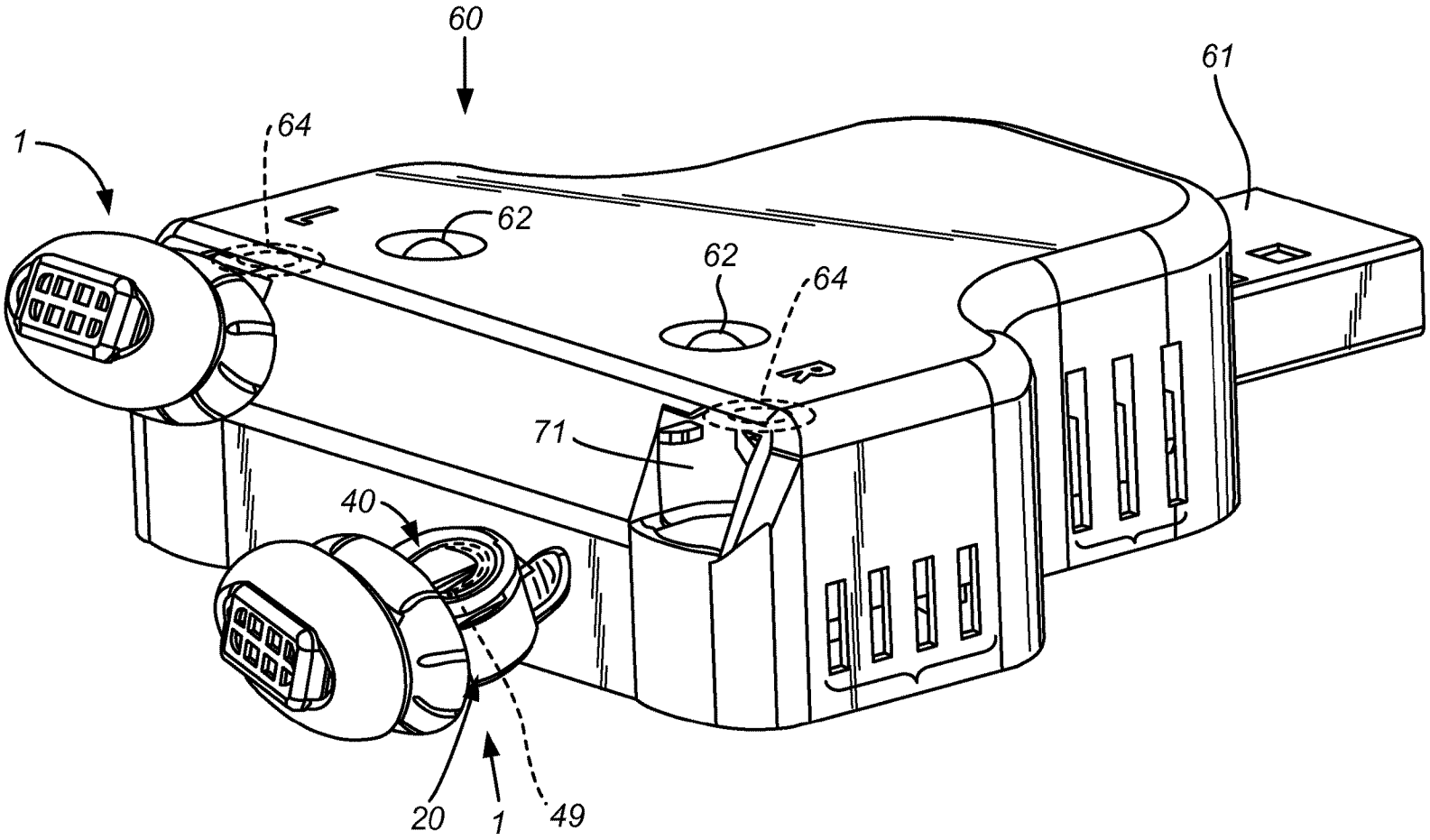
FIG. 4 is an isometric view of alternate embodiments of canal hearing device assemblies and a charging station with wireless charging functionality.
Figure 5:
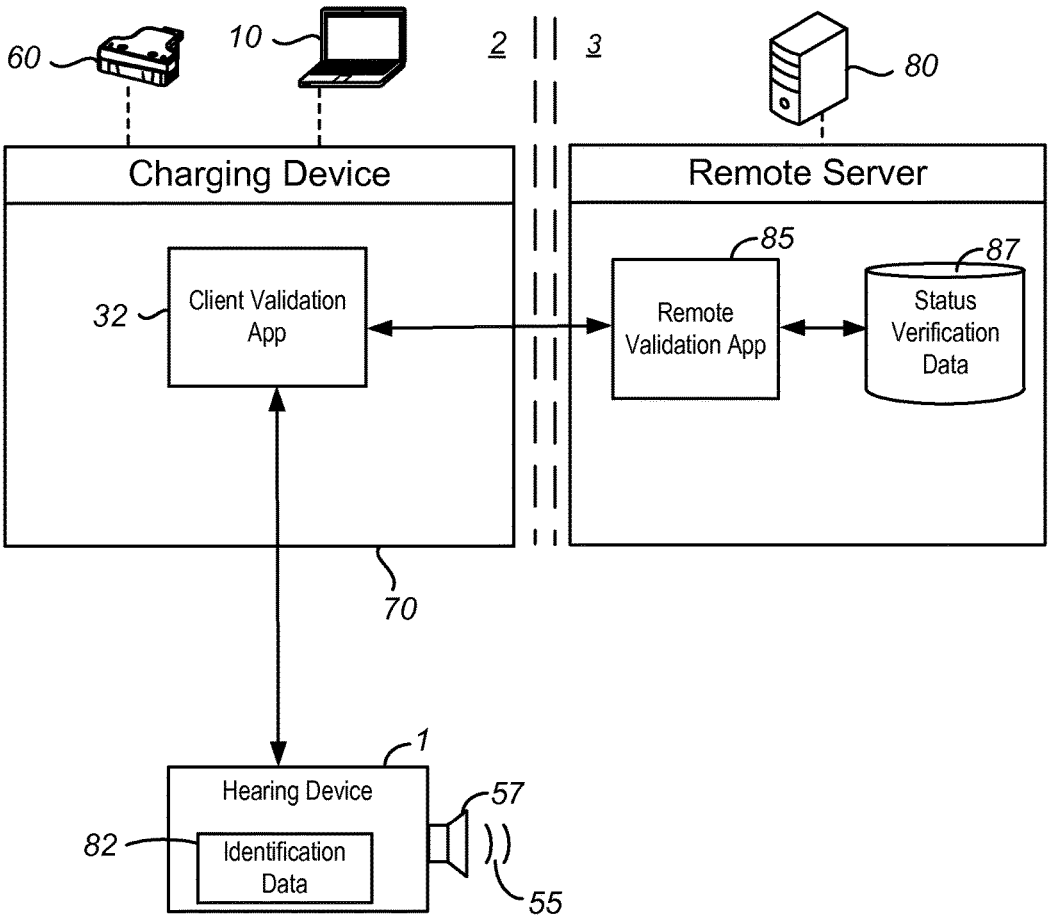
FIG. 5 is a schematic view of a rechargeable hearing device system including functionality for selectively charging and/or enabling functionality of a hearing device in accordance with some examples herein.

The charging station 60 may include one or more receptacle cavities 71, each of which may be adapted for receiving the lateral end of a canal hearing device 1. FIGS. 3-5 show examples of a charging station 60 with a plurality of receptacle cavities 71. In some examples, the charging station 60 may include two receptacle cavities 71 to accommodate a pair of hearing devices 1, such as a left and a right canal hearing devices. In some embodiments, each receptacle cavity 71 includes features for disengaging the lateral section 40 upon insertion of the canal hearing device 1. In some examples, the charging station 60 may include a battery to provide an internal power source to charge the hearing device 1 when inserted into the charging station 60 without resorting to external power during charging. The battery of the charging station 60 may be a primary cell or a rechargeable cell. In some examples, the charging station 60 comprises a connector 61, such as USB connector, to receive power from an external power source, for example from a USB port. The connector 61 may be provided via a cable (not shown) to connect the charging station 60 to an external power source, such as a standard wall outlet, a computing device 10, or any other power source. In some examples, the charging station 60 may include an indicator 62, for example an LCD or LED indicator, to indicate the status of the charging cycle, the battery cell condition, and/or the charger condition to the subscriber user 100. In some examples, the charging circuitry 65 includes a microprocessor or a microcontroller (not shown) for executing a software application, for example the subscription validation app 66 for charging according to the validity of the subscription.

The receptacle cavity 71 of the charging station 60 may include features configured to actuate the handle portion 50, or a switch, for electrical disengagement of the battery cell 42 from the canal hearing device assembly 1. For example, the receptacle cavity 71 and features included therein may be used to switch the hearing device 1 to the OFF condition for charging as described herein.

In some examples, the charging port provided within the receptacle cavity 71 may include a thermistor element (not shown) for sensing the temperature proximate to the rechargeable battery cell 42 when the lateral end of the canal hearing device 1 is inserted within the receptacle cavity 71. The charge cycle may be continued or interrupted responsive to the temperature detected by the thermistor.

In some examples, as shown in FIG. 4, the charging station 60 may utilize a wireless (contactless) inductive charging mechanism. In this configuration, inductive coils 64 (also referred to as transmission coils) are located within the housing of the charging station 60 to inductively couple electrical energy to an inductive coil 49 (also referred to as receiving coil) integrated within the lateral end of the canal hearing device assembly 1.

In some examples, the charging station 60 may include wireless electronics for wireless communications using a wireless protocol, such as Bluetooth Low Energy (BLE), Wi-Fi, and/or any other wireless protocol. The wireless electronics may transmit programming signals to the canal hearing device 1. The charging station 60 may be communicatively coupled to a wireless router 72, or any other type of device to access a network 85, for example the Internet, using Wi-Fi or Bluetooth.

In some examples, the charging device (e.g., charging station 60, computing device 10) may be communicatively coupled (e.g., via the network 85) to a remote server 80. The remote server 80 may be communicatively coupled to a storage device 87 comprising status verification data (e.g., subscription data 83). The remote server 80 may be programmed to execute software for performing functions described herein. For example, the remote server 80 may be configured to execute a remote validation app 86 for communicating status verification data from storage device 87 and/or verifying the status of the hearing device 1. The status of the hearing device 1 may be a subscription status, which may be based on any of a variety of metrics. For example, the status may be based on a number of charge cycles that the hearing device 1 has already undergone. In some examples, the status may be based on a duration of time of charging of the hearing device 1. In some examples, the hearing device 1 and/or the charging device may comprise circuitry configured to count the charge cycles of the hearing device 1. In some examples, the hearing device 1 and/or charging device may comprise a clock or timer configured to record a duration of charging time of the hearing device 1. In some examples, the hearing device 1 and/or charging device may store a subscription credit count, for example a number charge cycles or a time duration. The hearing device 1 and/or charging device may decrement the subscription credit count based on usage by the user 100. In some examples, the remote server 80 may store the subscription credit. The computing device 10 may periodically communicate with the remote server 80 to synchronize the subscription credit count based on usage, renewals, cancellations, etc. The computing device 10 may enable or disable charging and/or other functionalities of the hearing device 1 following synchronization with the remote server 80.

In some examples, the charging station 60 or computing device 10 may receive identification data 82 from the hearing device 1. The identification data 82 may be used to verify or authenticate a subscription associated with the hearing device 1. In some examples, the charging station 60 or the computing device 10 may be coupled to a remote server 80 with access to subscription data 83 via a network 85 (e.g., the Internet), as shown in FIGS. 5-8. The subscription data 83 may associate identification data 82 of the hearing device 1 with a subscription status. The subscription status may include a valid or an invalid subscription condition. In some examples, the computing device 10 may be communicatively coupled to the remote server 80 and subscription database 84 for verification of the subscription for the hearing device 1. In some examples, the charging station 60 enables or disables the charging of the hearing device 1, or enables or disables a wireless service, according to a subscription status. In some examples, the computing device 10 may enable to disable the charging of the hearing device 1, according to the subscription status. The wireless service may be control of an appliance (e.g., electronic lock, electronic lighting, etc.) or other wireless functionality of the hearing device 1. The charging of the hearing device 1 may be enabled or disabled by the charging station 60, the computing device 10, or charging circuitry 77 within the hearing device 1. In some examples, the charging station 60 or the computing device 10 may verify the subscription status prior to transmitting electrical charge to the hearing device 1. In some examples, the charging circuitry of the charging station 60, computing device 10, or hearing device 1 may receive an enabling or disabling signal to enable or disable charging, respectively, in accordance with the subscription status.

In some examples, the computing device 10 may request access to subscription data 83 from the remote server 80. The request transmitted to the remote server 80 may include identification data 82 associated with the hearing device 1 or the user 100. In some examples, the request may be initiated upon coupling of the charging port of the charging station 60 or the computing device 10 with the hearing device 1, for example upon insertion of the hearing device 1 into the charging port of the charging station 60 or the computing device 10. In some examples, the request may be initiated in response to axial insertion (e.g., by an insertion force) of the hearing device 1 into the receptacle cavity 71, whereby electrical contact is made between the electrical contacts 46*a* and 46*b* of the hearing device and the electrical contacts 76*a* and 76*b* of the hearing device 1. In some examples, the request may be initiated upon coupling the hearing device 1 to the computing device 10 using a charging cable, for example a standard connection USB cable. In response to the request, the computing device 10 may receive subscription data 83 or a subscription validation from the remote server 80. When receiving subscription data 83, the computing device 10 may determine a validity of the subscription via a client subscription validation application 30. In some examples, the computing device 10 may submit validation data to the remote server 80 for starting, renewing, canceling, or resuming a subscription.

Figure 6:
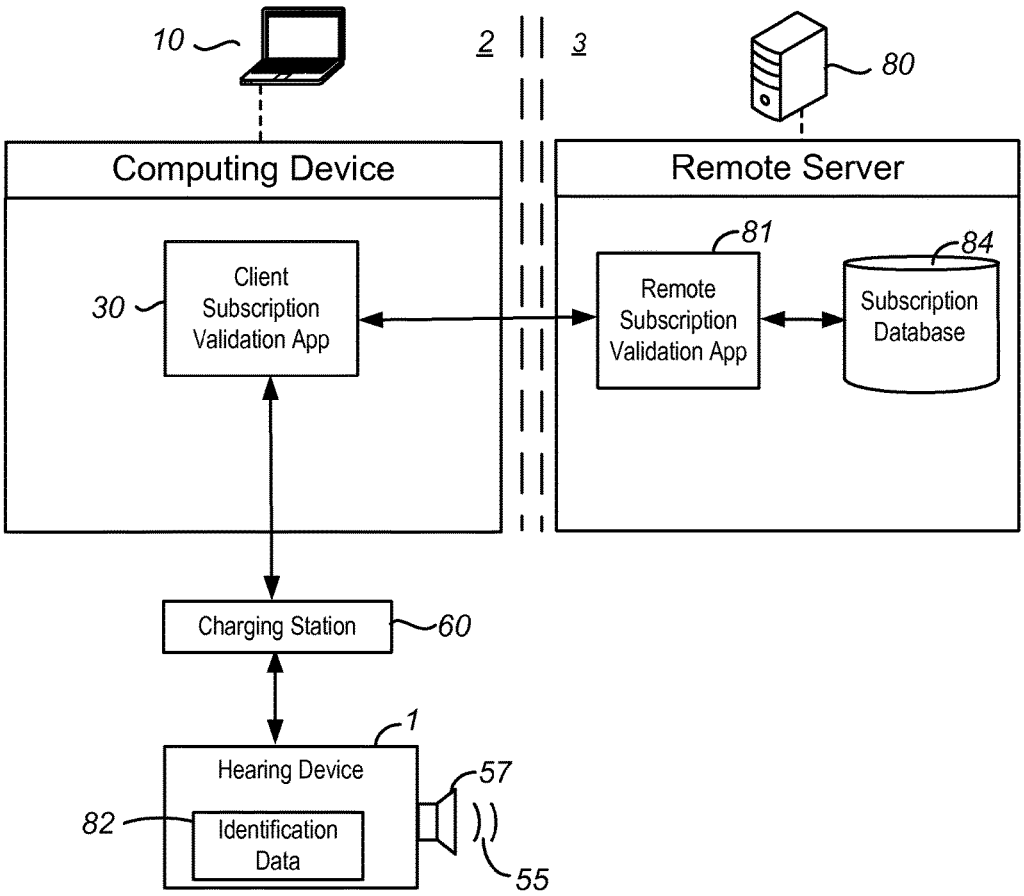
FIG. 6 is a schematic view of a subscription controlled rechargeable hearing device system including a hearing device, a charging station, a client computer, and a remote server.
Figure 7:
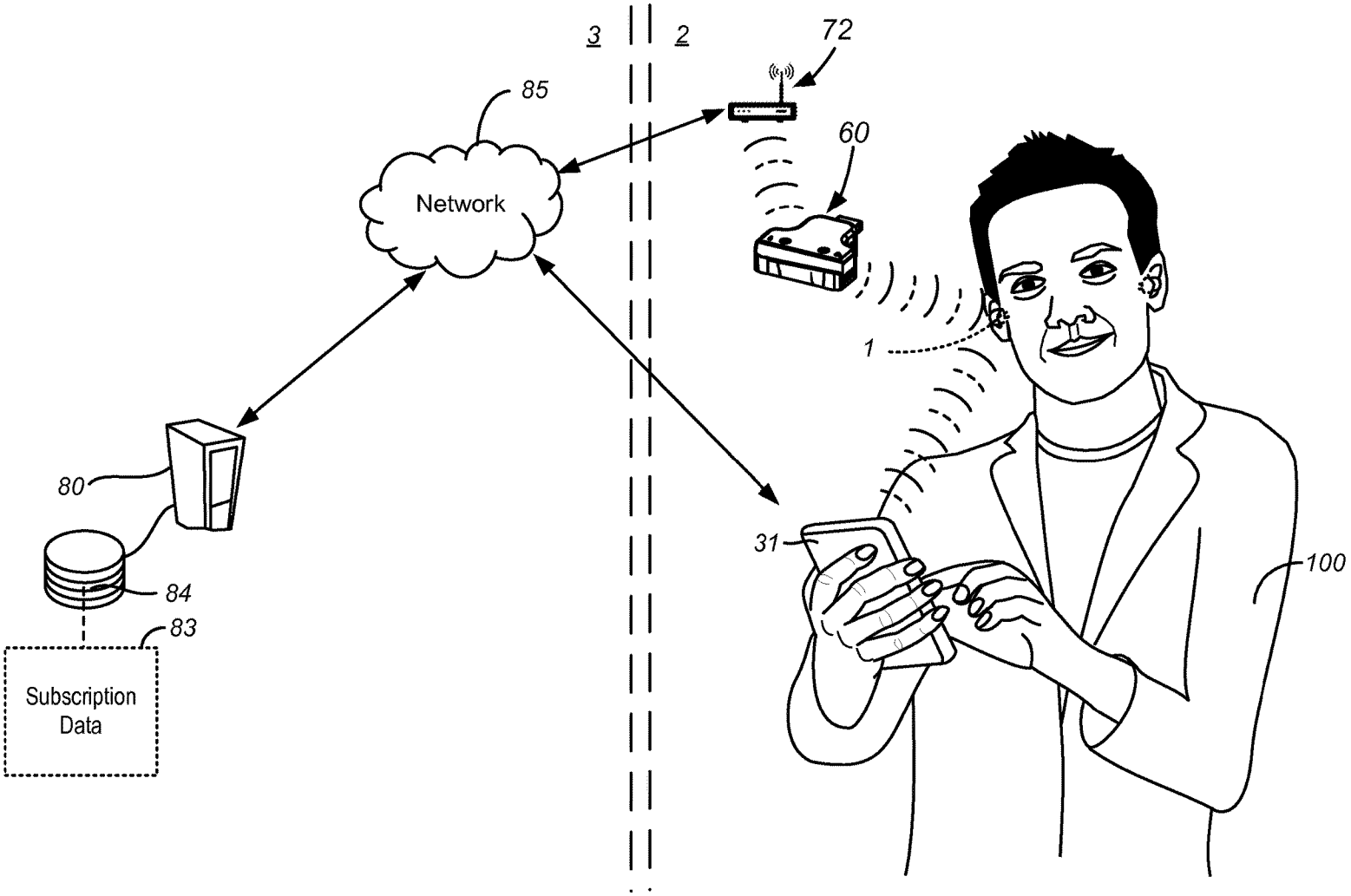
FIG. 7 is a schematic view of a charging station in communication with a server via a router and the Internet.
Figure 8:
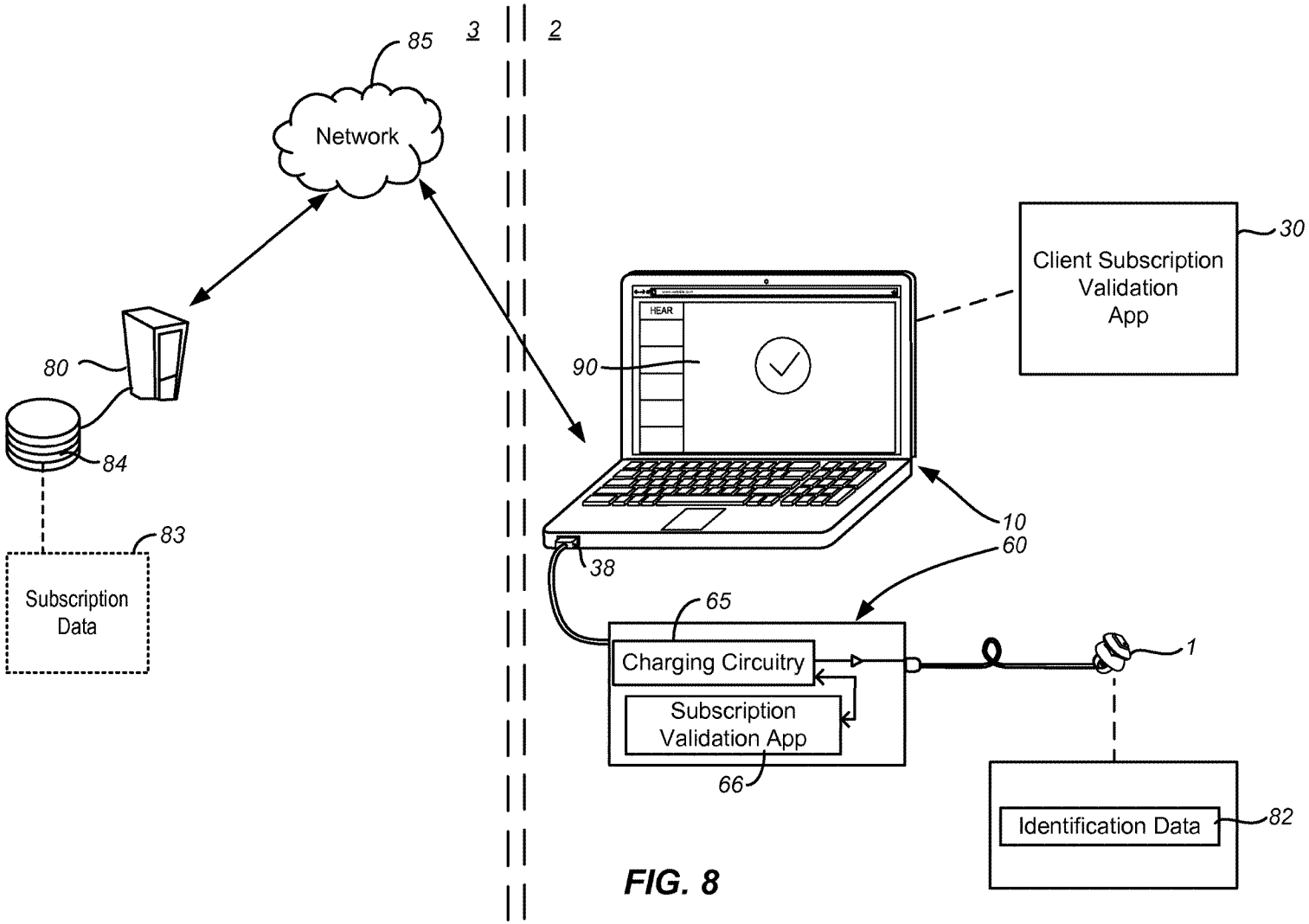
FIG. 8 is a schematic view of a subscription controlled rechargeable hearing device system comprising a remote server in communication with a hearing device using a computing device and a charging station.
Figure 9:
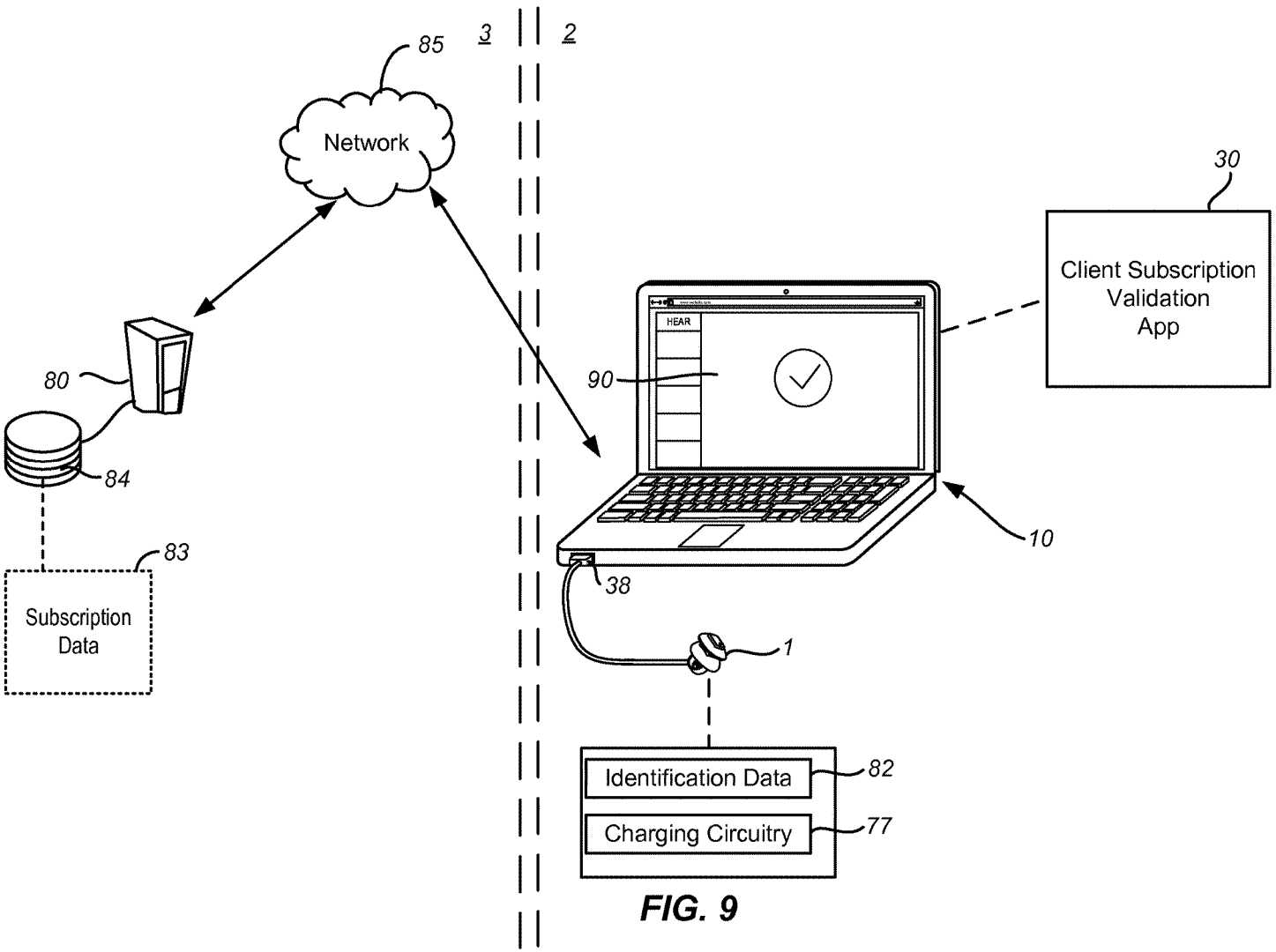
FIG. 9 is a schematic view of a subscription controlled rechargeable hearing device system comprising a rechargeable hearing device coupled to a computing device.

A software application for control or validation of a subscription may be executed by any device associated with the rechargeable hearing device 1, such as the computing device 10 (e.g., client subscription validation app 30), the remote server 80 (e.g., remote subscription validation app 81), or the charging station 60 (subscription validation app 66), as shown in FIGS. 6 and 8. The software application may initiate a subscription validation request and/or initiate the charging of the hearing device 1 upon subscription validation. In some examples, the software application may be embedded, browser-based or standalone. In some examples, the software application may include embedded code executable by the charging station 60. In some examples, the hearing device user 100 may be required to login to access the software application. The software application may include a user interface 90 for logging in, viewing a subscription, and/or modifying the subscription.

The remote server 80 provided on a server side 3 may be accessible via the network 85 to any devices communicatively associated with the rechargeable hearing device 1 on a client side 2, such as the charging station 60, a computing device 10 (e.g., a smartphone 31), etc. The remote server 80 may receive requests for validation of a subscription from the charging station 60 or the computing device 10 associated with the rechargeable hearing device 1 or the user 100. The remote server 80 may access subscription data 83 from a subscription database 84. The remote server 80 may deliver subscription data 83 or validation data to the computing device that requested validation of a subscription of a user 100 or potential subscriber of the hearing device 1. Subscription data 83 may include a subscription validity determination and/or may be used to validate the subscription.

In some examples, the remote server 80 on the server side 3 may host a remote subscription validation application 81. The remote subscription validation application 81 may determine subscription validity using a subscription database 84. In some examples, a subscription validation application 66 may be executed from the charging station 60. In some examples, a client subscription validation application 30 may be executed by the local computing device 10 for determining subscription validity. For example, the subscription validation application 66 may initiate the subscription validity determination upon detection of the hearing device 1 by the charging station 60. The subscription validation application 66 may request the subscription validity determination. The request may include submitting identification data 82 associated with the hearing device 1 connected to the charging station 60. It should be understood that the charging station 60 may be included as a part of a computing device 10, which may be a personal computer, a tablet, or a Smartphone. The client subscription validation application 30 executed on the computing device 10 may be in communication with the remote subscription validation application 81 for determining subscription validity. In some examples, the remote subscription validation application 81 may receive identification data 82 and determine subscription validity using the subscription database 84. The subscription validity determination may be transmitted to the client subscription validation application 30. In some examples, the client subscription validation application 30 may transmit a request for subscription data 83 to the remote subscription validation application 81. The client subscription validation application 30 may receive the subscription data 83 and make a subscription validity determination.

In some examples, charging of the hearing device 1 by the charging station 60 or the computing device 10 may be enabled upon a determination of a valid subscription. Charging may be enabled or disabled according to the subscription validity condition, for example a valid subscription condition or an invalid subscription condition.

In some examples, the software application of the computing device 10, charging station 60, and/or the remote server 80 may include functionality to automatically detect when the charging electrical contacts 46*a* and 46*b* of the canal hearing device assembly 1 are in contact with electrical contacts 76*a* and 76*b* of the charging station 60. In some examples, the detection occurs upon coupling the hearing device 1 to the computing device 10. In some examples, the detection may occur by the wireless electronics of the charging station 60 when the canal hearing device 1 is positioned proximate thereto. Upon detection of electrical contact with the canal hearing device 1 or wireless proximity, the software application may initiate a subscription validation request, and proceed with charging if the subscription is validated. The software application may initiate a subscription validation request in response to detecting a hearing device in proximity. The subscription validation request may also be initiated in response to a user 100 activating a switch 78*a-c* of the canal hearing device assembly 1 and/or using a wireless service of the hearing device 1.

Identification data 82 for a hearing device 1 may include a serial number, user name or identification number, or any other kind of identification data stored in the hearing device 1. In some examples, the identification data 82 may be provided by a user 100. When the subscription validation application is executed by the charging station 60 or the computing device 10, identification data 82 may be delivered to the remote server 80 by an Internet connection. In some examples, the client subscription validation application 30 may receive or determine the subscription status from the remote server 80 for charging or programming the hearing device 1.

The remote server 80 may receive the identification data 82 and query a subscription database 84 for subscription data 83 associated with the identification data 82, as shown in FIGS. 6-9. In some examples, the remote server 80 may deliver the subscription data 83 obtained from the database 84 to the device that requested it, for example the charging station 60, the hearing device 1, or the computing device 10. In some examples, the remote server 80 may perform a validation of a subscription and transmit a determination of the subscription status, such as whether the subscription is valid or not, to the device that requested it.

In some examples, a subscription may be determined to be invalid, for example due to a non-payment or subscription expiration. When the subscription is determined to be invalid, charging circuitry 65 of the charging station 60 or charging circuitry 77 within the hearing device 1 may be disabled to prevent charging of the hearing device 1. An indicator may alert the user 100 of the invalid subscription. The indicator may be a light or a display element in the graphical user interface 90. In some examples, the charging station 60 or the hearing device 1 may allow a limited number of charging cycles upon invalid subscription determination to allow the subscriber user 100 a reasonable time period (e.g., a grace period) to remedy the cause of invalid subscription. The limited charge may charge the battery cell 42 fully one time, or only partially charge the battery cell 42. In some examples, the hearing device 1 may be reprogrammed or disabled upon a determination of an invalid subscription. The hearing device 1 may transmit a warning message via a speaker 57 of the hearing device 1 to alert the subscriber user 100 about the need to re-validate the subscription, for example by making a payment.

Examples disclosed herein offer a subscription-based charging to allow a consumer to purchase or lease a hearing device with minimal upfront payment, while ensuring adequate revenue stream for a manufacturer or a professional dispensing the hearing device.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A rechargeable hearing device system comprising:

a hearing device for enhancing hearing ability comprising a speaker positioned inside the ear, the hearing device configured to receive electrical energy in accordance with a subscription of the hearing device, wherein memory of the hearing device stores identifying information of the hearing device;

a server hosting information about the subscription of the hearing device; and a charging device configured to receive the information about the subscription of the hearing device from the server when the charging device is communicatively coupled to the hearing device and provide electrical energy to the hearing device responsive to a validation of the subscription of the hearing device, wherein the validation of the subscription of the hearing device is based on the identifying information stored in the memory of the hearing device.

2. The rechargeable hearing device system of claim 1, wherein the charging device is configured to enable a charging port of the charging device in accordance with the information about the subscription of the hearing device received from the server.

3. The rechargeable hearing device system of claim 1, wherein the charging device is a computing device configured to be coupled to the hearing device via a wired connection.

4. The rechargeable hearing device system of claim 1, wherein the server is communicatively coupled to a storage device comprising the information, and wherein the charging device is configured to determine a subscription status of the hearing device using the information received from the server.

5. The rechargeable hearing device system of claim 1, wherein the charging device is a charging station, wherein the charging station is configured to be coupled to a computing device.

6. A rechargeable hearing device comprising:

a speaker configured for placement in the ear, the speaker further configured to deliver sound for enhancement of hearing ability; and a memory comprising identification data, wherein the rechargeable hearing device is configured to transmit the identification data to a charging device for validation of a subscription of the hearing device, wherein the hearing device is configured to receive electrical charge from the charging device responsive to a validation of the subscription of the hearing device, wherein the charging device is configured to receive information about the subscription of the hearing device from a server hosting information about the subscription of the hearing device, wherein the validation of the subscription of the hearing device is based on the identification data.

7. A subscription-based hearing device system comprising:

a rechargeable hearing device for enhancing hearing ability, the hearing device comprising a speaker configured for placement in the ear and memory storing identifying information of the hearing device, wherein the heating device is configured to receive electrical energy in accordance with a subscription of the hearing device; and a charging device configured to receive information about the subscription of the hearing device when the hearing device is coupled thereto; and a remote server configured to access subscription data stored on a remote subscription database, wherein the charging device is configured to receive information indicative of a validation of the subscription of the hearing device from the remote server, and wherein the charging device further comprises charging circuitry configured to selectively provide electrical charge to the hearing device if the information received is indicative of a valid subscription.

8. The subscription-based hearing device system of claim 7, wherein the charging device comprises a charging port, wherein a rechargeable battery cell of the hearing device is configured to at least partially disengage from the hearing device when coupled to the charging port.

9. The subscription-based hearing device system of claim 7, wherein the hearing device comprises wireless circuitry.

10. The subscription-based hearing device system of claim 7, wherein the charging device is a charging station, the system further comprising a computing device configured to couple to the charging station.

11. The subscription-based hearing device system of claim 10, wherein the computing device is communicatively coupled to the charging station using USB interface.

12. The subscription-based hearing device system of claim 10, wherein the computing device is communicatively coupled to the remote server, wherein the computing device is configured to request a subscription validity determination from the remote server.

13. The subscription-based hearing device system of claim 7, wherein the remote server is configured to perform a subscription validity determination, and wherein the subscription data comprises the subscription validity determination.

14. The subscription-based hearing device system of claim 7, wherein the charging station is configured to perform a subscription validity determination using the information.

15. The subscription-based hearing device system of claim 7, wherein charging device is a computing device configured to perform a subscription validity determination using the information.

16. A subscription-based hearing device system comprising:

a rechargeable hearing device for enhancing hearing ability, the hearing device comprising memory storing identifying information of the hearing device for validation of a subscription of the hearing device;

a charging circuitry for charging of the hearing device in accordance with the subscription of the hearing device;

a computing device configured to receive the identifying information from the hearing device and information about the subscription of the hearing device, wherein the computing device is configured to provide electrical charge to the charging circuitry if the information about the subscription of the hearing device is indicative of a valid subscription;

a remote server accessible to the computing device, the remote server configured to access subscription data on a remote subscription database and provide information about the subscription of the heating device to the computing device; and a software program communicatively coupled to the charging circuitry, wherein the software program is configured to control the charging circuitry responsive to a determination of a valid subscription.

17. A subscription-based hearing device system comprising:

a programmable hearing device for enhancing hearing ability comprising a rechargeable battery cell and a speaker, wherein the hearing device further comprises memory storing identifying information of the hearing device and fitting parameters;

a server hosting information about a subscription of the hearing device;

a programming interface configured to deliver a programming signal to the programmable hearing device, wherein the program signal is operable to adjust one or more of the fitting parameters;

a computing device configured to receive information about the subscription of the programmable hearing device from the server when the computing device is communicatively coupled to the hearing device; and a charging circuitry configured to charge the rechargeable battery cell responsive to a validation of the subscription of the hearing device, wherein the validation of the subscription of the programmable heating device is based on the identifying information stored in the memory of the programmable hearing device.

18. The subscription-based hearing device system of claim 17, wherein server is configured to retrieve subscription data from a remote subscription database based on the identifying information stored in the memory of the programmable hearing device.

19. The subscription-based hearing device system of claim 17, wherein the information about the subscription of the programmable hearing device received by the computing device comprises a subscription validity determination.

20. The subscription-based hearing device system of claim 17, further comprising a charging station incorporating the charging circuitry, wherein the charging station is configured to communicatively couple to the computing device.

21. The subscription-based hearing device system of claim 17, wherein the charging circuitry is integrated within the programmable hearing device.

22. The subscription-based hearing device of claim 20, wherein the charging station is configured to determine a validity of the subscription of the programmable hearing device using the identifying information received from the programmable hearing device.

23. The subscription-based hearing device system of claim 17, wherein the server is configured to determine a valid subscription using subscription data retrieved from a remote subscription database and the identifying information of the programmable hearing device.

24. The subscription-based hearing device system of claim 21, wherein the programming interface is configured to enable or disable features of the programmable hearing device according to the subscription of the programmable hearing device.

25. A method for charging a rechargeable battery cell of a hearing device, the method comprising:

coupling a hearing device for enhancing hearing ability to a charging device, wherein the charging device is configured to selectively provide electrical charge to a rechargeable battery cell of the hearing device responsive to a validation of a subscription of the hearing device;

transmitting identification data from memory of the hearing device to the charging device;

receiving information about the subscription of the hearing device from a server hosting information about the subscription of the hearing device; and providing electrical charge to the rechargeable battery cell if the information received is indicative of a valid subscription of the heating device, wherein the validity of the subscription of the hearing device is determined based on the identification data of the hearing device.

26. The method of claim 25, further comprising executing a software application on the charging device, receiving the identification data from the hearing device coupled thereto, transmitting a validation request to the remote server, receiving verification data from the server.

27. The method of claim 25, wherein the subscription is associated with a number of charge cycles, wherein the charging device is configured to cause the number of charge cycles associated with the subscription to decrement after providing electrical charge to the rechargeable battery cell.

28. The method of claim 25, further comprising disabling charging circuitry of the charging device responsive to an invalidity determination of the subscription of the hearing device.

29. The method of claim 25, wherein the charging device is a charging station configured to be communicatively coupled to the server, wherein the server is configured to validate the hearing device by accessing a remote subscription database storing subscription data.

30. The method of claim 25, wherein providing electrical charge to the rechargeable battery cell includes coupling the rechargeable battery cell to a source of electrical charge via direct electrical connection with electrical contacts of the charging device or via a wireless connection with an inductive coil of the charging device.

31. The method of claim 30, wherein further comprising selectively enabling a wireless service of the hearing device based on the information about the subscription of the hearing device.

32. A method for a subscription-based charging of a hearing device for enhancing hearing ability comprising:

inserting a lateral end of the hearing device into a receptacle cavity of a charging station, the receptacle cavity configured to automatically electrically disengage a rechargeable battery cell provided within the hearing device;

applying an insertion force to disengage the rechargeable battery cell from the hearing device and to electrically engage the hearing device with the charging station for charging the hearing device;

receiving identifying information of the hearing device from the hearing device;

receiving information about a subscription status of the hearing device from a server by a software application when the charging station is communicatively coupled to the hearing device, wherein the subscription status comprises a validation of a subscription of the hearing device determined based on the identifying information of the hearing device; and charging the hearing device by the software application if the subscription status is indicative of a valid subscription.

33. A subscription-based hearing device system comprising:

a hearing device for enhancing hearing ability comprising a wireless circuitry, wherein the hearing device is configured to receive electrical energy responsive to a validation of a subscription of the hearing device;

a charging circuitry for charging of the hearing device, wherein the charging circuitry is configured to receive identifying information from the hearing device and information about the subscription of the hearing device; and a remote server accessible through a network, wherein the remote server is configured to retrieve subscription data associated with a subscription from a subscription database and provide information about the subscription of the hearing device to the charging circuitry, wherein the charging circuitry is configured to enable or disable charging of the hearing device or a wireless service provided by the hearing device if the information received about the subscription of the hearing device is indicative of a valid subscription.

34. The subscription-based hearing device system of claim 33, wherein the charging circuitry is configured to enable or disable charging of the hearing device in-situ.

35. The subscription-based hearing device system of claim 33 wherein a subscription status comprises a valid subscription condition and an invalid subscription condition, wherein the subscription status is determined by comparing the subscription data to identification data of the hearing device, and wherein the charging circuitry is disabled responsive to a determination of an invalid subscription condition.

36. The subscription-based hearing device system of claim 33, wherein the charging circuitry is integrated within any of a computing device, a charging station, and the hearing device.

* * * * *